US005870952A

United States Patent [19]

Eichner et al.

[11] Patent Number: 5,870,952

[45] **Date of Patent: *Feb. 16, 1999**

[54] DAMPING UNIT BOX FOR A DAMPING UNIT OF AN OFFSET PRINTING MACHINE

[75] Inventors: Helmut Eichner, Bobingen; Paul Steidle, Grossaitingen; Hermann Vogele, Augsburg, all of Germany

[73] Assignee: MAN Roland Druckmaschinen AG, Offenbach am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 613,430

[22] Filed: Feb. 29, 1996

[30] Foreign Application Priority Data

Mar. 3, 1995 [DE] Germany ..... 295 03 535.8

[51] Int. Cl.[6] ..... B41F 31/06; B41F 7/32

[52] U.S. Cl. ..... 101/148

[58] Field of Search ..... 101/350, 351, 101/352, 363, 364, 366, 207–210, 148, 147

[56] References Cited

U.S. PATENT DOCUMENTS

| | | | |
|---|---|---|---|
| 2,368,500 | 1/1945 | Taylor et al. | 101/350 |
| 3,352,317 | 11/1967 | Dahlgren | 101/148 X |
| 3,904,524 | 9/1975 | Pelton et al. | 210/94 |
| 3,931,424 | 1/1976 | Heif et al. | 161/36 |
| 4,497,250 | 2/1985 | Dressler | 101/350 |
| 4,666,193 | 5/1987 | Hockett | 285/238 X |
| 5,098,221 | 3/1992 | Osborne | 405/52 |

FOREIGN PATENT DOCUMENTS

| | | |
|---|---|---|
| 0403382 | 12/1990 | European Pat. Off. . |
| 0437665 | 7/1991 | European Pat. Off. . |
| 2056542 | 5/1971 | France . |
| 2129707 | 10/1972 | France . |
| 3443510 | 6/1986 | Germany . |

*Primary Examiner*—J. Reed Fisher

*Attorney, Agent, or Firm*—Cohen, Pontani, Lieberman & Pavane

[57] ABSTRACT

A damping unit box for a damping unit of an offset printing machine, which box includes an inner basin-shaped wall and an outer basin-shaped wall that are separated by a heat insulating space to form a double-wall structure.

15 Claims, 1 Drawing Sheet

DAMPING UNIT BOX FOR A DAMPING UNIT OF AN OFFSET PRINTING MACHINE

BACKGROUND OF THE INVENTION

1. Field of the Invention

The invention relates to a damping unit box for a damping unit of an offset printing machine.

2. Description of the Related Art

A damping unit box of this type is known from EP 0 437 665 B1. This known damping unit box is connected to a temperature device for setting and maintaining the temperature of the damping medium for the offset printing machine. The cooled damping medium is taken from a damping medium supply container, moderated to a target temperature, supplied via a supply line to the damping unit box, taken from the latter by a damping ductor and transferred by means of damping rollers onto a form cylinder. The damping medium is cooled to a temperature that lies, for example, between 2 and 10° C. A draw-back of this construction is the difficulty of keeping the damping medium cooled.

SUMMARY OF THE INVENTION

Accordingly, it is an object of the present invention to provide a damping unit box of the aforementioned type in which the damping medium contained in it does not heat up appreciably.

Pursuant to this object, and others which will become apparent hereafter, one aspect of the present invention resides in a damping unit box for a damping unit, which damping box has a double-walled construction formed of inner and outer wall portions that have a heat insulating separation space therebetween. In addition to maintaining the temperature, the invention has the advantage that no condensation water, which could drop onto the printing web, forms on the underside of the damping unit box.

Pursuant to a further embodiment of the invention, a heat-insulating material, such as a mounting foam or a microcellular rubber is arranged in the separating space so as to take up at least a portion of the volume of the space.

In an especially advantageous embodiment of the damping unit box, a dam is arranged in the damping unit box to regulate the level of the damping medium in the damping unit box. The dam is arranged in a tiltable manner so that when the dam is tilted up, dirt particles that have settled on the bottom of the damping unit box are swept away by the rapid outflow of the damping medium. This allows the damping unit box to be cleaned quickly and conveniently. Also, the development of permanent deposits is avoided. To seal the dam, a sealing lip, for example, of rubber, is provided on the edge of the dam that rests on the bottom of the damping unit box. Because of this, the dam is completely sealed off relative to the damping unit box. In order to facilitate the flow of the damping medium over the dam, crenellations are provided on the upper side of the dam. Furthermore, support tabs are arranged on the sides of the dam to facilitate the upward tilting of the dam by pressing down on the support tabs.

In still a further embodiment of the invention, a discharge gutter for the damping medium is arranged in the bottom of the box, in the region below the damping ductor roller, at an angle of 90° relative to the flow direction of the damping medium. This prevents air bubbles from developing when the damping medium flows out of the damping unit box. Thus, the flow of damping medium is always laminar.

The construction of the invention thus provides several advantages, including: the avoidance of condensation water on the underside of the damping unit box; an even flow of the damping medium without formation of air bubbles; good means of cleaning the damping unit box; after the printing unit is shut off, the rapid outflow of damping medium by tilting up the dam, while avoiding deposits; and a constant damping medium level is maintained even at low damping medium throughput.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
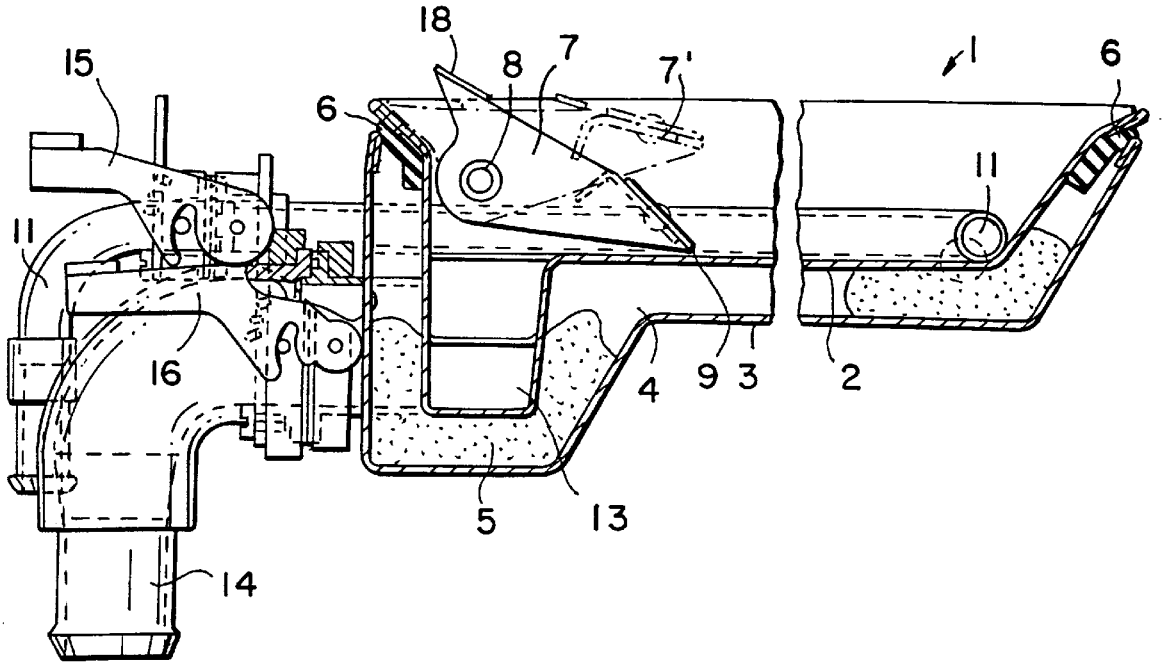
FIG. 1 shows a damping unit box pursuant to the present invention, in cross-section.
Figure 2:
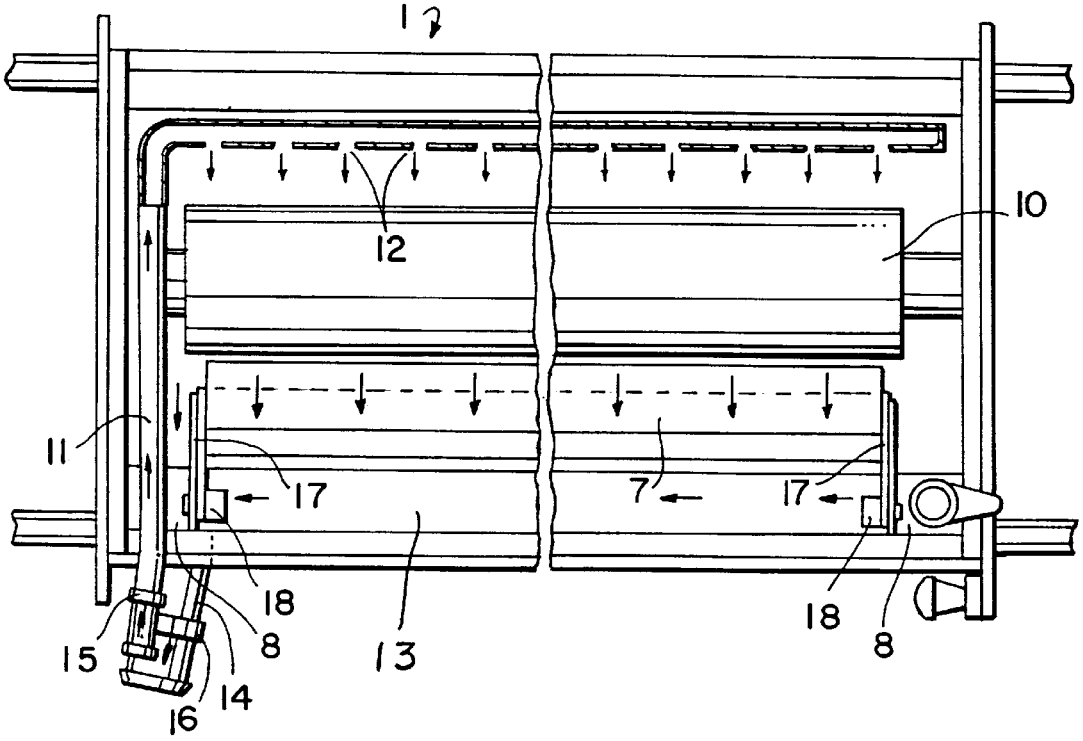
FIG. 2 is a top view on the damping unit box of FIG. 1.

A damping unit box 1 is shown in FIGS. 1 and 2 and is filled with a damping medium, basically water. This medium is transferred by a damping ductor 10, i.e., a roller, via a set of damping rollers onto a form cylinder in an offset printing machine. The damping unit box 1 has two walls 2, 3 which form a basin. An outer wall 3 surrounds an inner wall 2 and defines the damping unit box 1. The walls 2, 3 are separated from one another by an thermally-insulating space 4. The space 4 is filled either completely or at only a few support points by a material 5 that is a poor heat conductor, for example, mounting foam, microcellular rubber, or another material. Otherwise, the walls 2, 3 are separated from one another by air spaces. The heat conductivity of the air is even lower than that of the material 5 located in the space 4. The two basins formed by the walls 2, 3 create a gap 6 between their upper peripheral edges. The gap 6 is sealed in an air-tight manner by a microcellular rubber or another thermally-insulating material. Because the damping medium in the damping unit box 1 has a temperature of, for example, 6° C., without the heat insulation of the damping unit box 1, drops of condensation would form on the side walls and on the underside of the box 1, which could fall onto the material to be printed.

A dam 7 is mounted on journals 8 in the damping unit box 1 so that it can swing upward into a position 7'. On the downwardly directed edge of the dam 7 there is a sealing lip 9, with which the dam rests on the bottom of the damping box 1. When a damping medium flows through a supply pipe 11, and emerges from numerous openings 12 in the pipe 11 into the damping unit box 1, the downwardly tilted dam 7 and its sealing lip 9 ensure that the damping medium enters at only a limited, laminar flow rate over the upper edge of the dam 7 and to the sides of the dam 7. The damping medium then flows through a discharge gutter 13, out of the damping unit box 1 and into a discharge pipe 14. The discharge pipe 14 seen in the flow direction of the damping medium, is arranged at the rear end of the discharge gutter 13. In the discharge gutter 13, the damping medium flows beneath the damping ductor 10 at an angle of 90° relative to the flow direction. Due to the discharge pipe 14 being arranged at the end of the discharge gutter 13, no air bubbles form during the outflow of the damping medium, because the damping medium constantly has a laminar flow. The supply pipe 11 as well as the discharge pipe 14 are preferably designed in a two-part fashion and, for example, can be taken apart by means of bayonet locks 15, 16. On its upper edge, the dam 7 preferably has crenellations, between which the damping medium flows into the discharge gutter 13. This embodiment of the dam 7 ensures that when the damping unit box 1 is filled, a liquid level up to the height of the upper edge of the dam is established within the shortest possible time.

In order to remove deposits of ink particles and contamination and the like that form on the bottom of the damping unit box 1, the dam 7 is tilted upward into the position 7' by pressing down on support tabs 18 attached to the side walls 17 of the dam 7. The damping medium is then able to flow out of the damping unit box 1 via the discharge gutter 13 rapidly enough so that all deposits on the bottom of the damping unit box 1 are swept along by the damping medium. In this way, the damping unit box 1 can be easily cleaned. In addition, the dam 7 can also be taken completely out of the damping unit box 1, insofar as its side walls 17 are constructed so that they can be curved elastically inward, allowing them to be removed from the journals 8.

The invention provides a double-walled damping unit box 1, the heat insulation of which prevents condensation water drops from forming on the underside and on the side walls of the damping unit box 1. The damping unit box 1 also has a removable and upwardly tiltable dam 7 that ensures a constant liquid level in the damping unit box 1 and permits the damping unit box 1 to be quickly cleaned by tilting of the dam 7 upward into a position 7' or by removing the dam 7.

The invention is not limited by the embodiments described above which are presented as examples only but can be modified in various ways within the scope of protection defined by the appended patent claims.

I claim:

1. A damping unit box for a damping unit of an offset printing machine, comprising an inner basin-shaped wall with an upper peripheral end edge and an outer basin-shaped wall with an upper peripheral end edge, which walls are separated by a heat insulating space and form a double-walled structure having a closed bottom and an open top, the upper peripheral end edges forming a gap therebetween; and thermally insulating material arranged in the gap between the upper peripheral end edges so that there is no direct contact between the inner wall and the outer wall.

2. A damping unit box as defined in claim 1, and further comprising a heat-insulating material arranged in the heat-insulating space.

3. A damping unit box as defined in claim 2, wherein the heat-insulating material takes up the entire volume of the heat-insulating space.

4. A damping unit box as defined in claim 2, wherein the heat-insulating material is only arranged to partially fill the heat-insulating space at selected locations.

5. A damping unit box as defined in claim 2, wherein the heat-insulating material is a mounting foam.

6. A damping unit box as defined in one of the claim 2, wherein the heat-insulating material is a microcellular rubber.

7. A damping unit box as defined in claim 1, and further comprising a dam mounted in the basin defined by the inner wall so as to be upwardly tiltable.

8. A damping unit box as defined in claim 7, wherein the dam has an upper side on which crenellations are provided.

9. A damping unit box as defined in claim 7, and further comprising support tabs mounted to the dam so that a downward force on the support tabs tilts the dam upwardly.

10. A damping unit box as defined in claim 7, and further comprising a discharge gutter formed in the bottom of the double-walled structure, below the dam.

11. A damping unit box as defined in claim 7, wherein the dam has a lower edge that rests against an inner surface of the inner wall at the bottom of the double-wall structure, and further comprising a sealing lip mounted to the lower edge of the dam.

12. A damping unit box as defined in claim 11, wherein the sealing lip is made of rubber.

13. A damping unit box as defined in claim 1, wherein the upper peripheral edge of the inner wall is connected to the upper peripheral edge of the outer wall in an airtight fashion by the thermally-insulating material.

14. A damping unit box as defined in claim 1, and further comprising a damping medium supply pipe releasably connected to the double-walled structure, a damping medium outflow pipe releasably connected to the double-walled structure, and bayonet lock means for releasably connecting the supply pipe and the outflow plate to the structure.

15. A damping unit box as defined in claim 10, wherein the discharge gutter is formed in the bottom of the structure so as to guide a damping medium at an angle of 90° relative to a flow direction of the damping medium into the structure.

* * * * *